United States Patent [19]

Rau et al.

[11] Patent Number: 4,958,732

[45] Date of Patent: Sep. 25, 1990

[54] SLIDE-TOP DRILL-BIT STORAGE BOX

[75] Inventors: Georg Rau, Giengen-Hohenhemmingen; Günter H. Budert, Bachhagel, both of Fed. Rep. of Germany

[73] Assignee: Firma Georg Knoblauch, Giengen/Brenz, Fed. Rep. of Germany

[21] Appl. No.: 437,827

[22] Filed: Nov. 16, 1989

[30] Foreign Application Priority Data

Nov. 26, 1988 [DE] Fed. Rep. of Germany ..... 3839993
May 12, 1989 [EP] European Pat. Off. ..... 89108568.0

[51] Int. Cl.[5] ..... B65D 85/24

[52] U.S. Cl. ..... 206/379; 206/443; 206/561

[58] Field of Search ..... 206/443, 379, 561

[56] References Cited

U.S. PATENT DOCUMENTS

| | | | |
|---|---|---|---|
| 1,024,388 | 4/1912 | Bartlett | 206/379 |
| 2,792,934 | 5/1957 | Rocchetti | 206/379 |
| 3,499,525 | 3/1970 | Kanter | 206/379 |
| 4,162,005 | 7/1979 | Lingen | 206/379 |
| 4,598,822 | 7/1986 | Hemmings | 206/379 |

*Primary Examiner*—Joseph Man-Fu Moy
*Attorney, Agent, or Firm*—Herbert Dubno; Andrew Wilford

[57] ABSTRACT

A storage case for elongated objects has a generally flat base part formed with an array of parallel and longitudinally extending grooves separated by longitudinally extending ridges. The grooves all are open longitudinally at one end and closed longitudinally at the opposite end. Thus the objects can be held in the grooves. A generally flat cover part engaged over the base part covers the grooves. The cover part has one transversely extending edge lip overreaching the open ends of the grooves and formed with a longitudinally throughgoing aperture of generally the same transverse width as the grooves and this cover part is slidable transversely along the base part for alignment of the aperture with the open end of each of the grooves. One of the parts is formed with a transversely extending notch formation open toward the other part and the other part is formed with a transversely extending rib formation generally complementary to and fitting into the notch formation.

11 Claims, 3 Drawing Sheets

FIG. 3
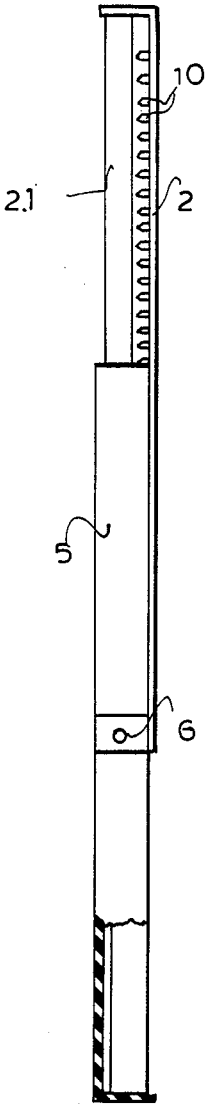
FIG. 2
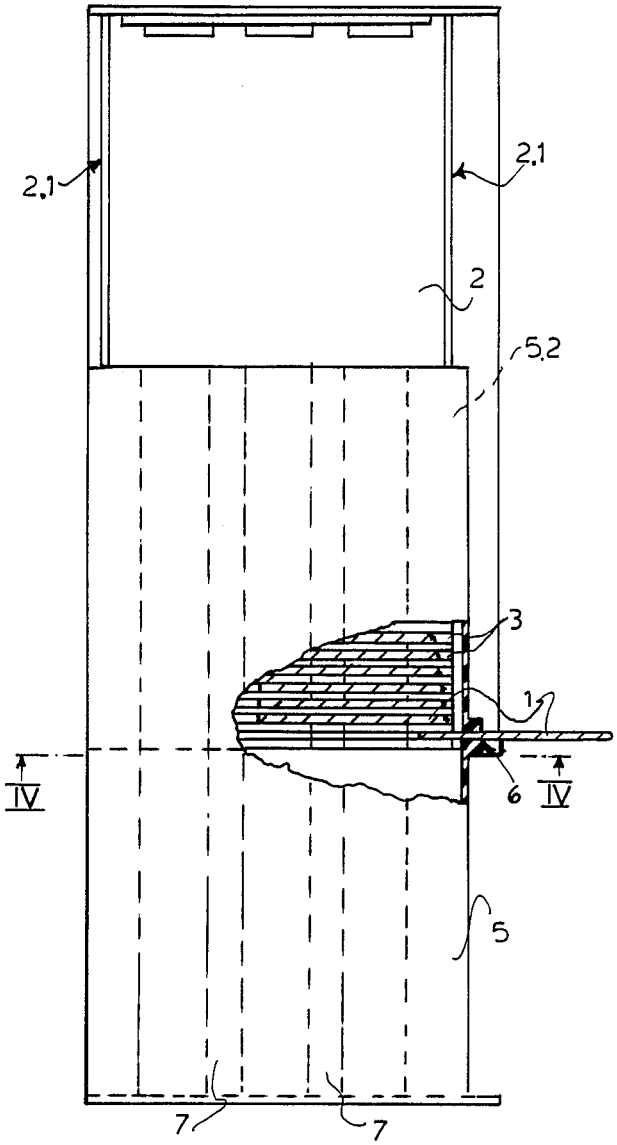
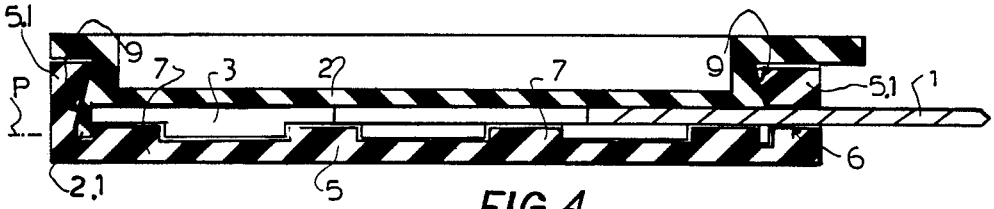
FIG. 4

SLIDE-TOP DRILL-BIT STORAGE BOX

FIELD OF THE INVENTION

The present invention relates to a storage box or case for elongated objects. More particularly this invention concerns a slide-type drill-bit storage box.

BACKGROUND OF THE INVENTION

It is known to store elongated objects such as drill bits in a case formed with a plurality of grooves each intended to receive a respective one of the bits. A cover closes the case to hold the bits in their respective grooves. To remove one of the bits the cover is removed and the desired bit is picked out, and to replace it the cover is similarly removed and the bit is dropped back into its place.

Such an arrangement has several disadvantages. When the case is open it is possible to accidentally dump out its entire contents in which case it becomes extremely difficult to replace them all in the right order as it is virtually impossible to gauge bit size by eye when they are very small. Furthermore when the bit diameter is very small, frequently less than 1.0 mm in diameter, it is possible for one bit to rattle from one groove to the next in the closed case, once again making it very difficult to determine what belongs where.

OBJECTS OF THE INVENTION

It is therefore an object of the present invention to provide an improved storage case for elongated objects.

Another object is the provision of such an improved storage case for elongated objects which overcomes the above-given disadvantages, that is which makes it easy to extract a single object at a time and wherein it is impossible for one object to move into the place of another in the closed case.

SUMMARY OF THE INVENTION

A storage case for elongated objects according to the invention has a generally flat base part formed with an array of parallel and longitudinally extending grooves separated by longitudinally extending ridges. The grooves all are open longitudinally at one end and closed longitudinally at the opposite end. Thus the objects can be held in the grooves. A generally flat cover part engaged over the base part covers the grooves. The cover part has one transversely extending edge lip overreaching the open ends of the grooves and formed with a longitudinally throughgoing aperture of generally the same transverse width as the grooves and this cover part is slidable transversely along the base part for alignment of the aperture with the open end of each of the grooves. One of the parts is formed with a transversely extending notch formation open toward the other part and the other part is formed with a transversely extending rib formation generally complementary to and fitting into the notch formation.

Thus with this arrangement the base part can be filled with the cover removed, then the cover is snapped in place and from then on in the objects can only be removed and replaced one at a time. The interfitting rib and notch prevent any of the objects from slipping between the cover and base from one groove to the other. The arrangement is therefore very handy, in particular for maintaining a stock of small-gauge twist bits orderly.

According to this invention the ridges have outer edges defining a plane and the rib formation projects from the other part past the plane. In addition the other part is formed with a plurality of such rib formations and the one part is formed with a corresponding plurality of complementary notch formations. Normally the other part is the cover part and the one part is the base part.

The base part in accordance with this invention is only formed with the grooves along about half of its transverse length and has an ungrooved portion. The formation of the base part only extends in the grooved half and the cover part is generally as long as the entire base part and its formation extends its full transverse length. Furthermore the base part is formed with a stop groove extending along generally half its length and the cover part is formed with a stop engaged in the stop groove and limiting sliding of the cove part on the base to the length of the groove. The cover part is generally U-shaped and has a pair of transversely extending dovetail-section lips embracing the base part. One of the lips is formed with a projection and the base part is formed for each groove with a recess in which the projection engages resiliently when the aperture is aligned with the respective groove.

Finally according to the invention the base part is provided at one end with a hanger connected via weakened break zones to the base part. The hanger is connected via two webs each having such a weakened break zone to the base part and the hanger is provided with a stop preventing sliding of the cover part relative to the base part while the hanger is on the base part. Thus the hanger can be used to suspend the case prior to sale and will prevent any of the bits from being taken except by the consumer.

DESCRIPTION OF THE DRAWING

The above and other objects, features, and advantages will become more readily apparent from the following, reference being made to the accompanying drawing in which:

FIGS. 2 and 3 are top and side views partly in section of the case of FIG. 1;

FIG. 4 is a large-scale section taken along line IV—IV of FIG. 2;

SPECIFIC DESCRIPTION

Figure 1:
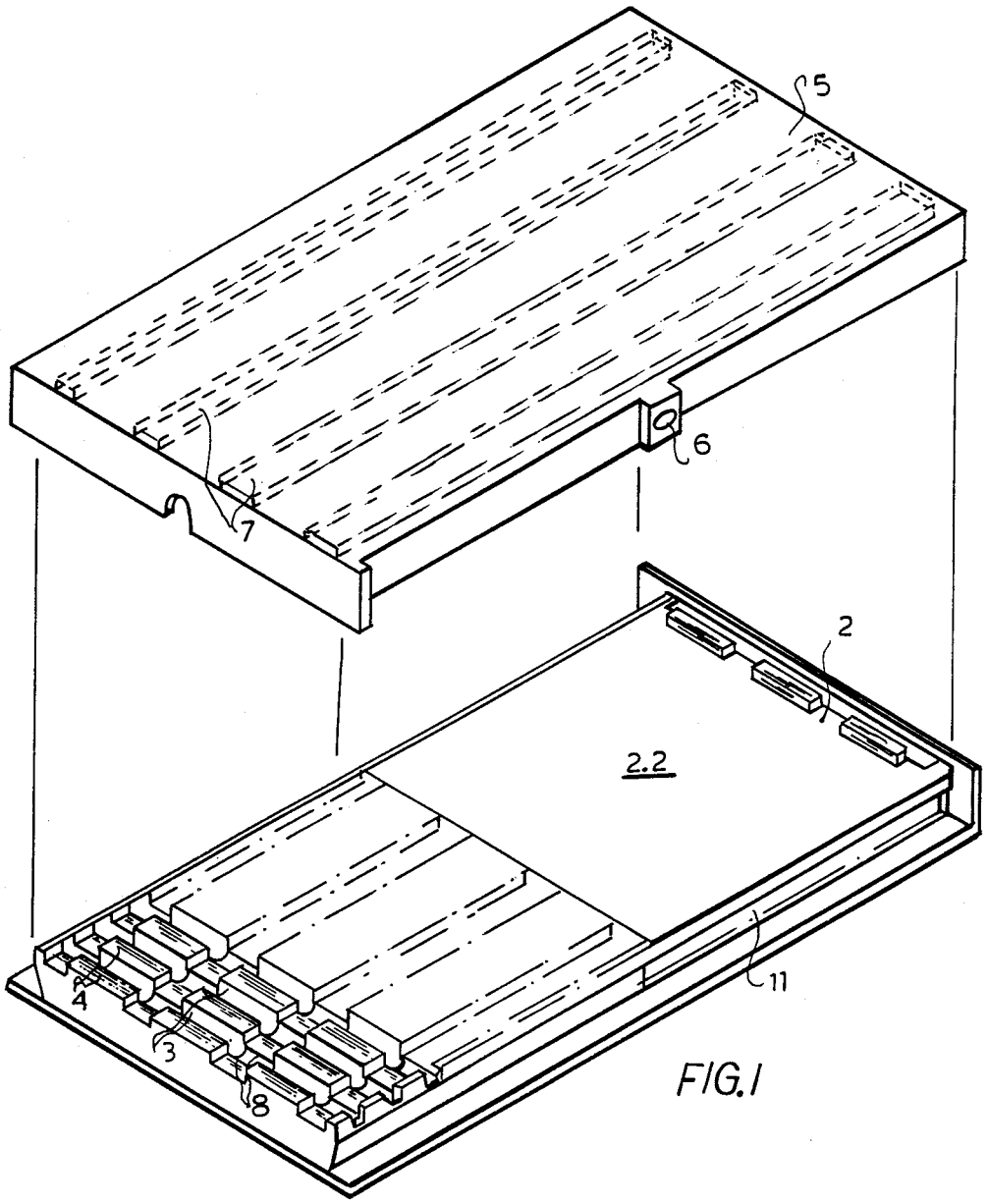
FIG. 1 is an exploded perspective view of a drill-bit storage case according to this invention.

As seen in FIGS. 1 through 4 a storage case for small-diameter drill bits 1 has a flat base part 2 formed entirely of a rugged synthetic resin and a similarly constituted cover part or slide 5 that is also flat. The base part 2 is formed along half its transverse width with an array of parallel and longitudinally extending grooves 3 separated by ridges 4 having outer edges lying in a plane P.

The cover part 5 has a pair of edge ridges or lips 5.1 that flare toward the base part 2 and that fit in complementarily tapered recesses 9 along the transverse edges thereof so that the to parts 2 and 5 are held together elastically against separation perpendicular to the plane P. The cover 5 can therefore slide transversely relative to the base 2 and is formed in one of its lips 5.1 with a transversely throughgoing hole or aperture 6 that can be aligned with any of the grooves 3, this aperture 6 being generally central in the cover 5. The base 2 is formed with a lips 2.1 one of which blocks the opposite longitudinal ends of the grooves 3 but the other of which is perforated so that these grooves 3 are open longitudinally in one direction and, of course, radially toward the plane P. The perforated web 2.1 is formed at its end past the grooves 3 with a recess 11 formed in turn with a plurality of shallow detent grooves 10 and the respective lip 5.1 is formed with a small bump 5.2 that engages in the recess 11 to prevent the cover 5 from moving transversely to a position exposing one of the grooves 3 and that also engages elastically in the detents 10 to define a plurality of stop positions each corresponding to alignment of the aperture 6 with a respective one of the grooves 3.

In order to prevent a bit 1 from shaking from one of the grooves 1 to the adjacent groove through the small space at the plane P between the cover 5 and base 2, the cover 5 is formed with a plurality, here four, of transversely extending ribs 7 that engage past the plane P in complementary grooves 8 cut into the ridges 4. The longitudinal spacing between adjacent ribs 7 is shorter than the shortest bit 1 so that it is impossible for one of these bits 1 to rattle into the next groove 3.

The supplier can fill the grooves 3 with bits when the two parts 2 and 5 are separate from each other, and then simply snap the cover 5 into place with some elastic deformation of the lips 2.1 and 5.1. Once thus assembled the only way normally to get a bit 1 out of the case is to align the aperture 6 with the desired bit and shake it loose. Indicia printed on the blank part 2.2 of the base 2 can align with the edge of the cover 5 to indicate which size bit is aligned with the hole.

Figure 5:
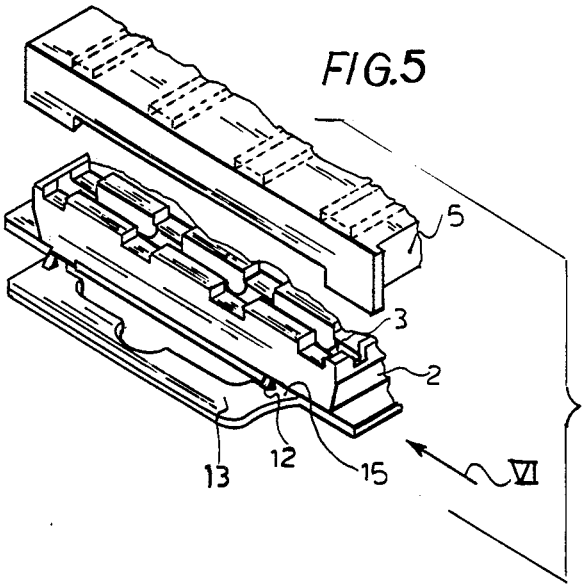
FIG. 5 is an exploded end view of a detail of this invention.
Figure 6:
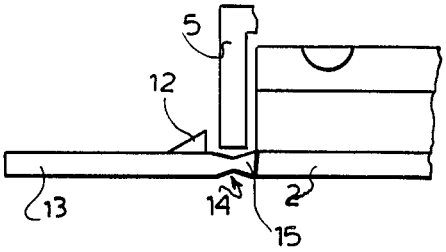
FIG. 6 is a large-scale end view taken in the direction of arrow VI of FIG. 5.

For marketing purposes as seen in FIGS. 5 and 6 the base 2 is formed at its one end with an integral extension 13 connected at pair of webs 14 each formed with a weakened region 15. This extension 13 has a sawtooth detent 12 whose right-angle flank directly faces the end of the cover 5 so that it normally inhibits sliding of the cover 5. The entire filled case 2, 5 can be hung up by this extension 13 which, therefore, allows it to be displayed and stocked easily. Prior to purchase the stop 12 also prevents any of the bits 1 from being taken.

After purchase the user merely bends back the tab 13 to break it off at 15, thereby eliminating the now unneeded hanger and also eliminating the stop 12 that prevents access to the bits 1.

I claim:

1. A storage case for elongated objects, the case comprising:

a generally flat base part formed with an array of parallel and longitudinally extending grooves separated by longitudinally extending ridges, the grooves all being open longitudinally at one end and closed longitudinally at the opposite end, whereby the objects can be held in the grooves; and a generally flat cover part engaged over the base part and covering the grooves, the cover part having one transversely extending edge lip overreaching the open ends of the grooves and formed with a longitudinally throughgoing aperture of generally the same transverse width as the grooves, the cover part being slidable transversely along the base part for alignment of the aperture with the open end of each of the grooves, one of the parts being formed with a transversely extending notch formation open toward the other part and the other part being formed with a transversely extending rib formation generally complementary to and fitting into the notch formation.

2. The storage case defined in claim 1 wherein the ridges have outer edges defining a plane and the rib formation projects from the other part past the plane.

3. The storage case defined in claim 1 wherein the other part is formed with a plurality of such rib formations and the one part is formed with a corresponding plurality of complementary notch formations.

4. The storage case defined in claim 1 wherein the other part is the cover part and the one part is the base part.

5. The storage case defined in claim 1 wherein the base part is only formed with the grooves along about half of its transverse length and has an ungrooved portion, the formation of the base part only extending in the grooved half, the cover part being generally as long as the entire base part and its formation extending its full transverse length.

6. The storage case defined in claim 5 wherein the base part is formed with a stop groove extending along generally half its length and the cover part is formed with a stop engaged in the stop groove and limiting sliding of the cover part on the base to the length of the stop groove.

7. The storage case defined in claim 1 wherein the cover part is generally U-shaped and has a pair of transversely extending dovetail-section lips embracing the base part.

8. The storage case defined in claim 6 wherein one of the lips is formed with a projection, the base part being formed for each groove with a recess in which the projection engages resiliently when the aperture is aligned with the respective groove.

9. The storage case defined in claim 1 wherein the base part is provided at one end with a hanger connected via weakened break zones to the base part.

10. The storage case defined in claim 9 wherein the hanger is connected via two webs each having such a weakened break zone to the base part.

11. The storage case defined in claim 9 wherein the hanger is provided with a stop preventing sliding of the cover part relative to the base part while the hanger is on the base part.

* * * * *